US011530535B2

(12) United States Patent
Lai

(10) Patent No.: US 11,530,535 B2
(45) Date of Patent: Dec. 20, 2022

(54) DIVIDING SCREEN STRUCTURE

(71) Applicant: KADEYA ENTERPRISE CO., LTD, Puxin Township, Changhua County (TW)

(72) Inventor: Ting-Yu Lai, Puxin Township, Changhua County (TW)

(73) Assignee: KADEYA ENTERPRISE CO., LTD, Changhua County (TW)

( * ) Notice: Subject to any disclaimer, the term of this patent is extended or adjusted under 35 U.S.C. 154(b) by 69 days.

(21) Appl. No.: 17/023,277

(22) Filed: Sep. 16, 2020

(65) Prior Publication Data

US 2021/0087811 A1 Mar. 25, 2021

(30) Foreign Application Priority Data

Sep. 19, 2019 (JP) ..... JP2019-003552

(51) Int. Cl.
*E04B 2/74* (2006.01)
*E04B 2/72* (2006.01)

(52) U.S. Cl.
CPC ..... *E04B 2/7405* (2013.01); *E04B 2/721* (2013.01); *E04B 2/7425* (2013.01); *E04B 2002/7468* (2013.01); *E04B 2103/00* (2013.01)

(58) Field of Classification Search
CPC ..... E04B 2/7405; E04B 2/7425; E04B 2/721; E04B 2103/00; E04B 2002/7468; E04F 2201/0517; Y10S 52/04; F16B 5/0028
USPC ..... 403/DIG. 1; 52/52, DIG. 4, 79.12, 79.9, 52/762, 770, 579
See application file for complete search history.

(56) References Cited

U.S. PATENT DOCUMENTS 2,079,635 A * 5/1937 Sharp ..... B63B 3/68 52/241
2,934,180 A * 4/1960 Hammitt ..... F16B 5/0028 52/781
3,982,370 A * 9/1976 Buffington ..... E04F 13/0883 52/511
4,703,603 A * 11/1987 Hills ..... F16B 5/0028 52/582.1
5,038,535 A * 8/1991 Van Praag, III ..... E04B 7/04 52/127.9
5,520,477 A * 5/1996 Fink ..... B65D 11/18 206/509
7,444,792 B2 * 11/2008 Matson ..... E04D 12/00 24/336
8,590,232 B2 * 11/2013 Roche ..... G09F 7/04 52/238.1

(Continued)

FOREIGN PATENT DOCUMENTS

CA 2781793 A1 * 10/2013 ..... B60P 3/1075
CH 662601 A5 * 10/1987 ..... E04B 2/7427

(Continued)

*Primary Examiner* — Brent W Herring

(57) ABSTRACT

A dividing screen structure has at least two screens and at least one assembling member mounted on one side of one of the two screens for connecting the two screens together. Each screen has a frame with at least one magnet on each side for pairing with the assembling member; the assembling member comprises at least two magnetically attracted U-shaped securing members, and each securing member has a back portion, two side portions and an opening.

6 Claims, 11 Drawing Sheets

(56) References Cited

U.S. PATENT DOCUMENTS

| | | | | |
|---|---|---|---|---|
| 8,844,207 | B2 * | 9/2014 | Bowers | E04F 15/107 52/DIG. 4 |
| 2002/0043349 | A1 * | 4/2002 | Rigby | E04B 2/7427 160/135 |
| 2014/0245692 | A1 * | 9/2014 | Bowers | E04F 15/107 52/582.2 |

FOREIGN PATENT DOCUMENTS

| | | | | |
|---|---|---|---|---|
| DE | 20210524 | U1 * | 10/2002 | E04B 2/7425 |
| EP | 0053933 | A1 * | 6/1982 | G09F 15/0068 |
| EP | 2990559 | A2 * | 3/2016 | E04B 1/612 |
| GB | 2468914 | A * | 9/2010 | E04B 2/7425 |

* cited by examiner

DIVIDING SCREEN STRUCTURE

BACKGROUND OF INVENTION

Field of Invention

The present invention relates to a dividing screen structure.

Description of Related Art

Currently, typical screens, as shown in FIG. 10, mainly utilize at least one magnet 40 on both sides of the frame 31 of the screen 30. The frame 31 is made of metal that can be attracted by the magnets 40. The frame 31 can attach to another adjacent screen 30 with the magnets 40 as shown in FIG. 11, so that the screens 30 can be positioned for mutual traction after being assembled.

However, the above-mentioned conventional screen structure still has the following problems in practical applications: the screen 30 utilizes the magnet 40 to attract the frame 31 and obtain mutual traction positioning after assembly, but the frame 31 can only be made of a metal which inevitable has problems of low material variability, heavy overall weight and high cost.

Therefore, it is desirable to provide a dividing screen structure to mitigate and/or obviate the aforementioned problems.

SUMMARY OF INVENTION

An objective of present invention is to provide a dividing screen structure, which is capable of improving the above-mention problems.

In order to achieve the above mentioned objective, a dividing screen structure has at least two screens and at least one assembling member mounted on one side of one of the two screens for connecting the two screens together. Each screen has a frame with at least one magnet on each side for pairing with the assembling member; the assembling member comprises at least two magnetically attracted U-shaped securing members, and each securing member has a back portion, two side portions and an opening.

Other objects, advantages, and novel features of invention will become more apparent from the following detailed description when taken in conjunction with the accompanying drawings.

DETAILED DESCRIPTION OF PREFERRED EMBODIMENT

Figure 1:
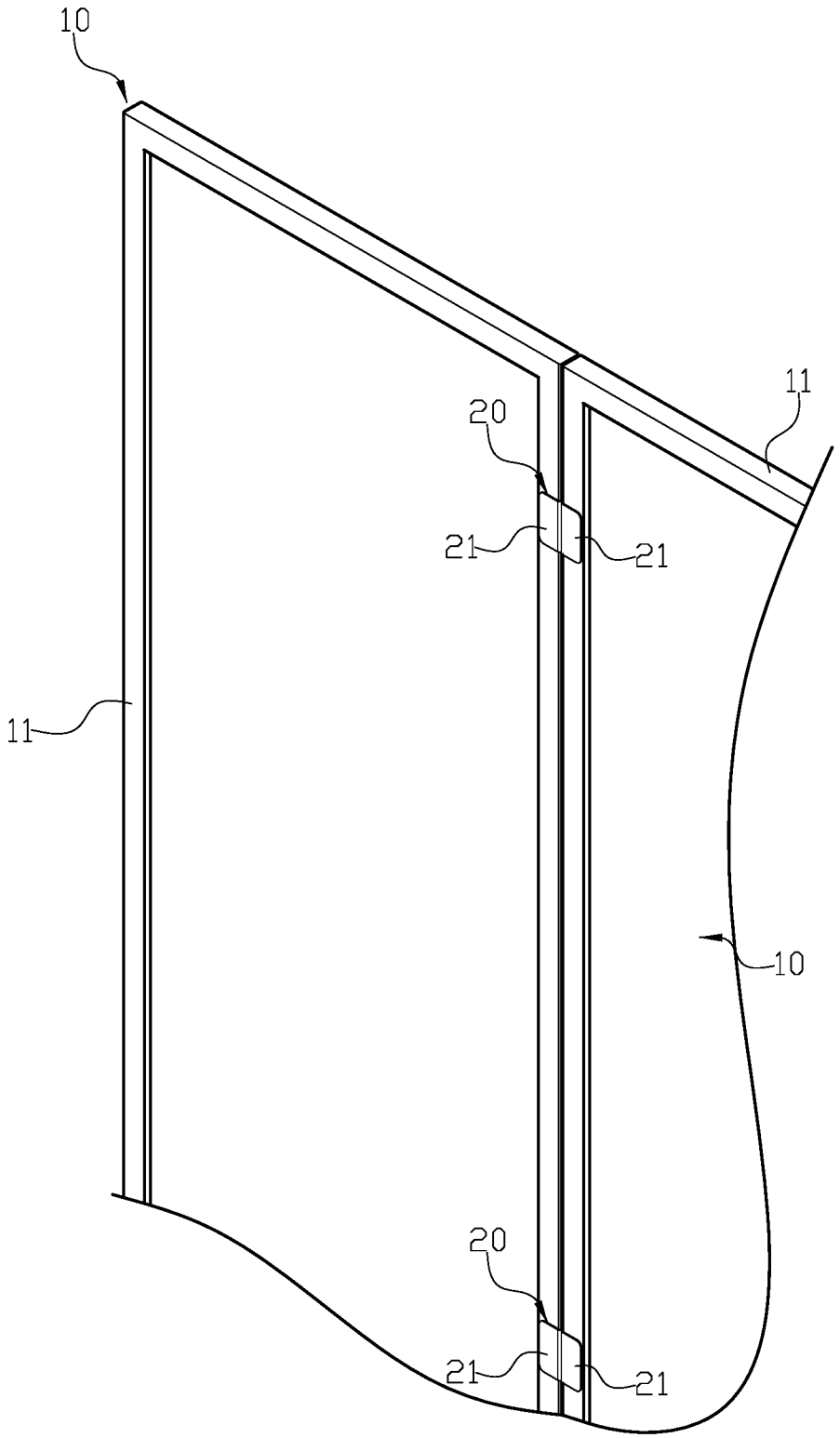
FIG. 1 is a three-dimensional combination drawing of the first preferred embodiment according to the present invention.
Figure 2:
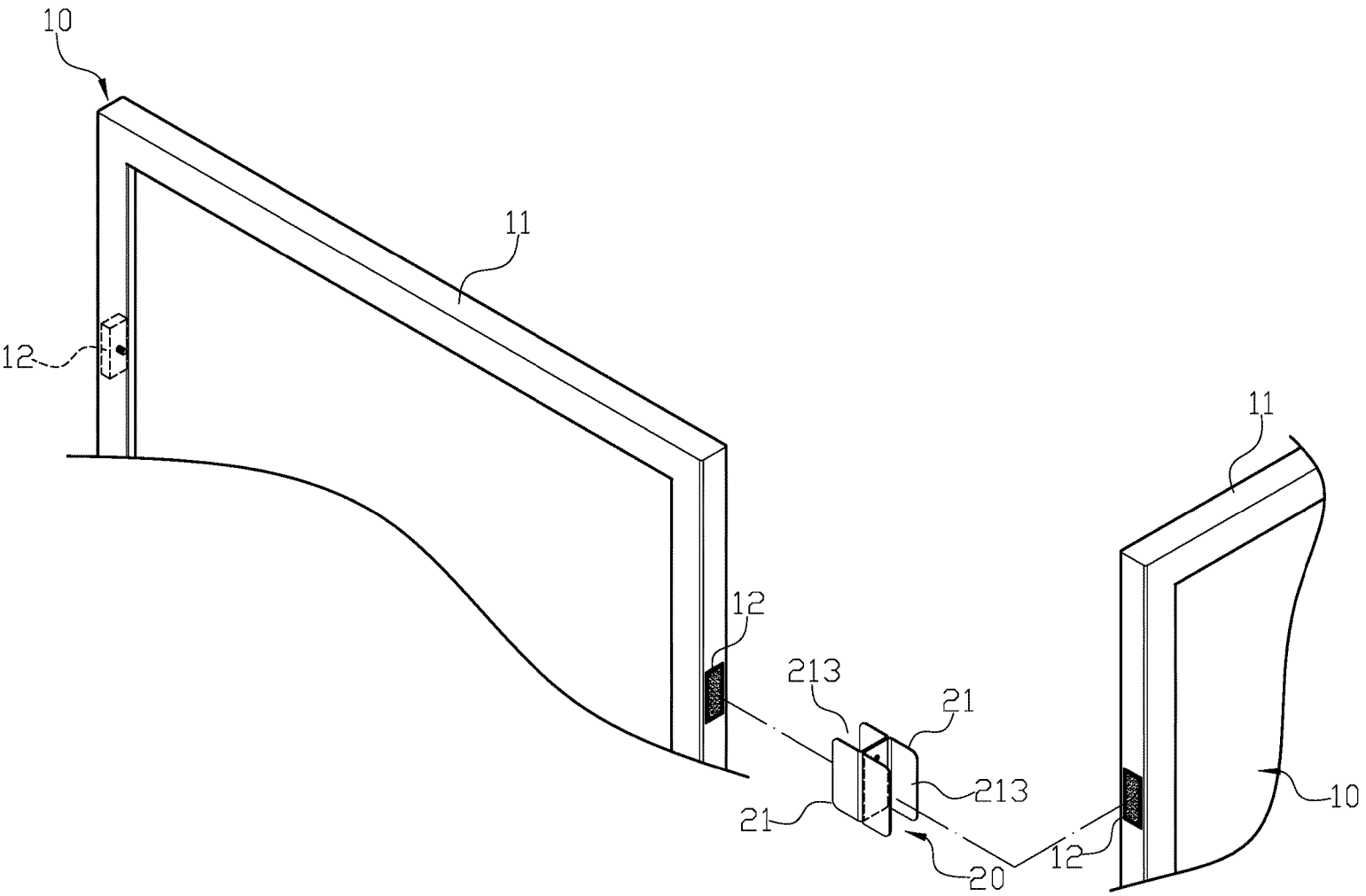
FIG. 2 is a three-dimensional exploded view of the first preferred embodiment according to the present invention.
Figure 3:
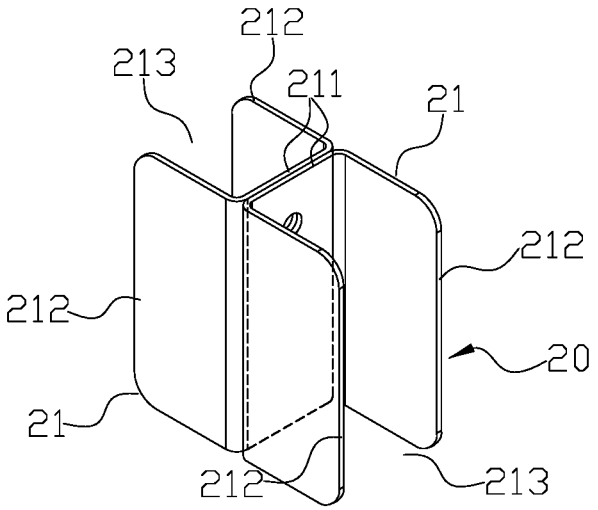
FIG. 3 is a three-dimensional enlarged view of the assembling member of the first preferred embodiment according to the present invention.
Figure 4:
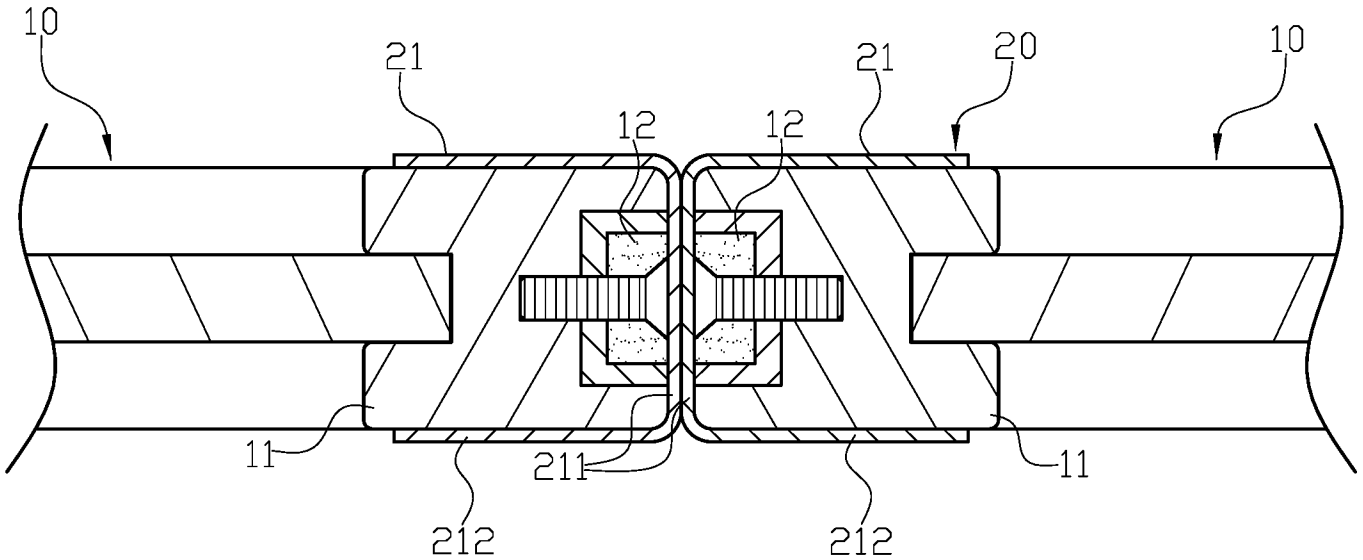
FIG. 4: is a combined cross-sectional view of the first preferred embodiment according to the present invention.

Please refer to FIGS. 1-4. A dividing screen structure comprises at least two screen 10 and at least one assembling member 20 mounted on one side of one of the two screens 10 for connecting the two screens 10 together. Each screen 10 has a frame 11 with at least one magnet 12 on each side for pairing with the assembling member 20. The assembling member 20 comprises at least two magnetically attracted U-shaped securing members 21, and each securing member 21 has a back portion 211, two side portions 212 and an opening 213. By assembling the securing members 21 differently, the opening 213 of each securing member 21 is able to face different direction. When the frame 11 of each screen 10 is inserted into the opening 213, the magnet 12 and the securing member 21 generate magnetic attraction to position the screen 10.

Furthermore, each assembling member 20 has two securing members 21 connected with a respective back portion 211, and the openings 213 of the two securing members 21 respectively accept a screen 10. Therefore, the two screens 10 are linearly connected, as shown in FIGS. 1-4.

Figure 5:
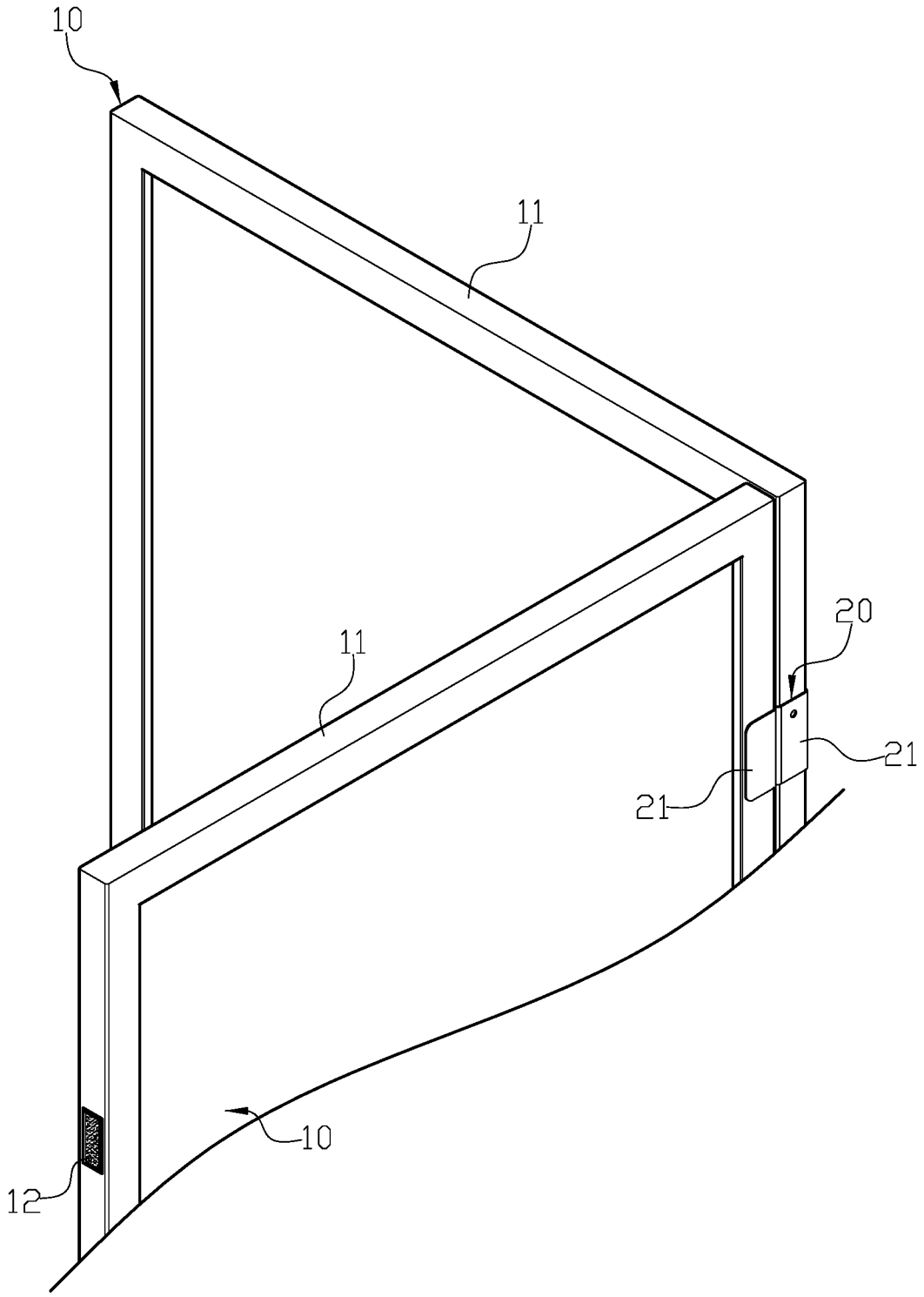
FIG. 5: It is a three-dimensional combined drawing of the second preferred embodiment according to the present invention.
Figure 6:
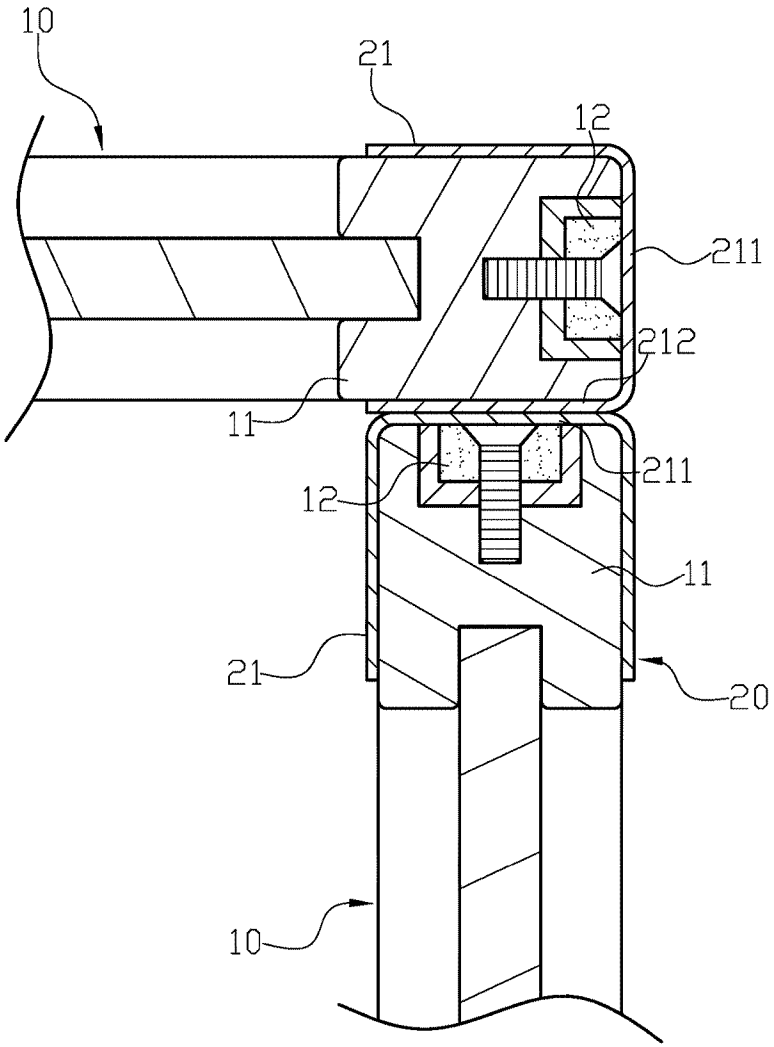
FIG. 6: is a combined cross-sectional view of the second preferred embodiment according to the present invention.

In addition, each assembling member 20 has two securing members 21, the back portion 211 of one of the securing members 21 is attached onto one of the side portions 212 of another securing member 21, and each opening 213 of the two securing members 21 respectively accepts a screen 10 to combine the two screens at a right angle, as shown in FIG. 5 and FIG. 6.

Figure 7:
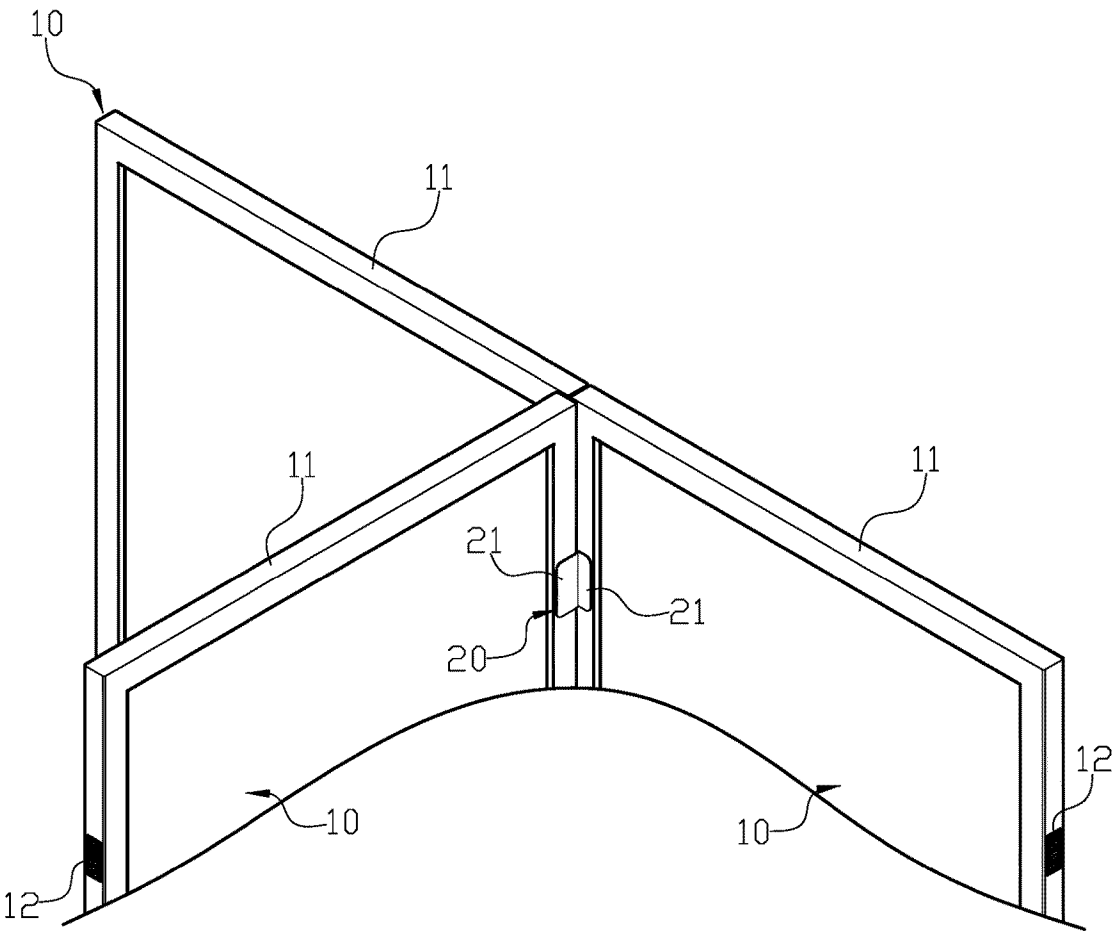
FIG. 7: is a three-dimensional combined drawing of the third preferred embodiment according to the present invention.
Figure 8:
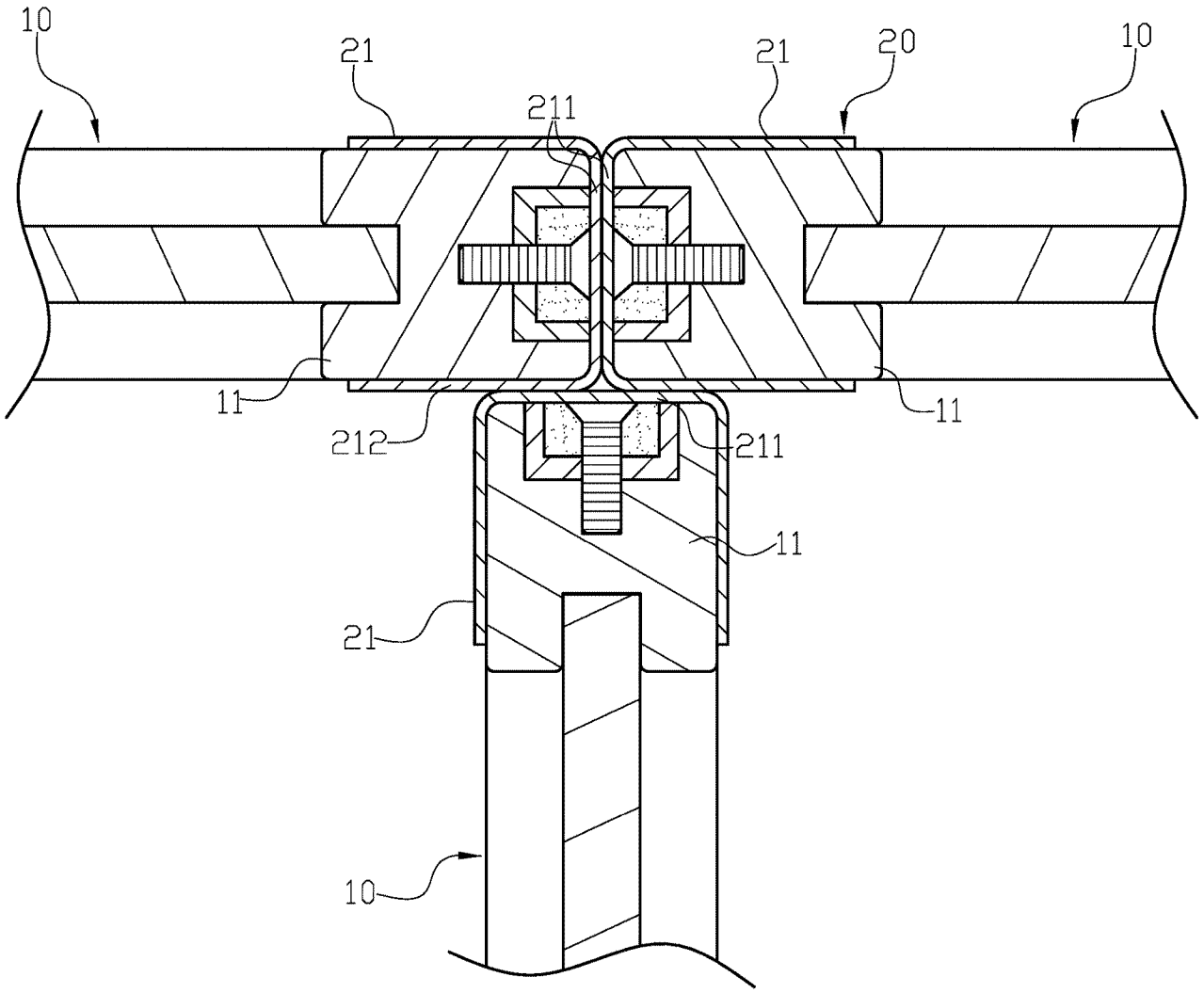
FIG. 8: is a combined cross-sectional view of the third preferred embodiment according to the present invention.

Moreover, each assembling member 20 has three securing members 21, two of the securing members 21 are connected with a respective back portion 211, the back portion of another securing member 21 is attached onto both of the side portions 212 of the two connected securing members 21, and each opening 213 of the three securing members 21 respectively accepts a screen 10 to combine three screens 10 into a T shape, as shown in FIG. 7 and FIG. 8.

Figure 9:
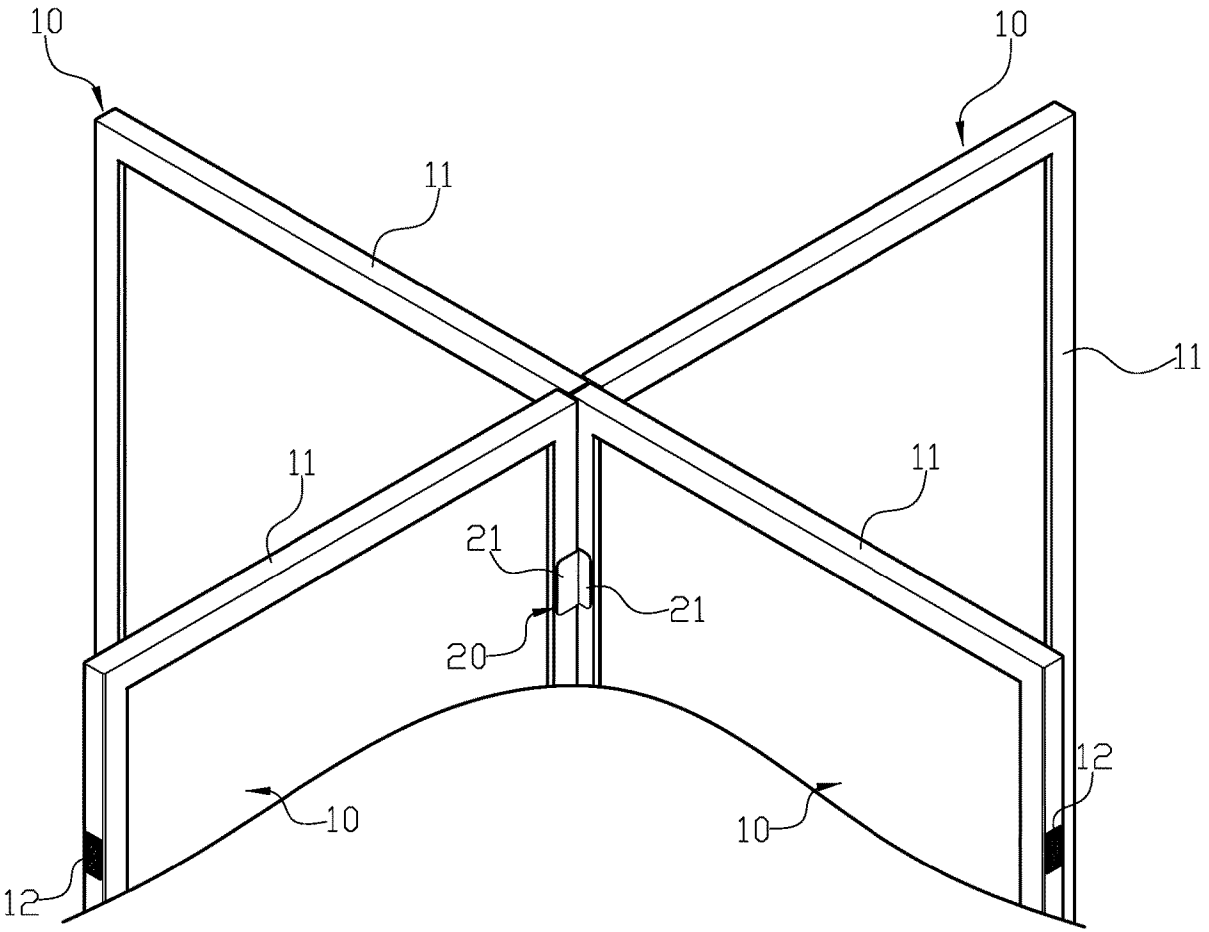
FIG. 9: is a three-dimensional assembly drawing of the fourth preferred embodiment according to the present invention.
Figure 10:
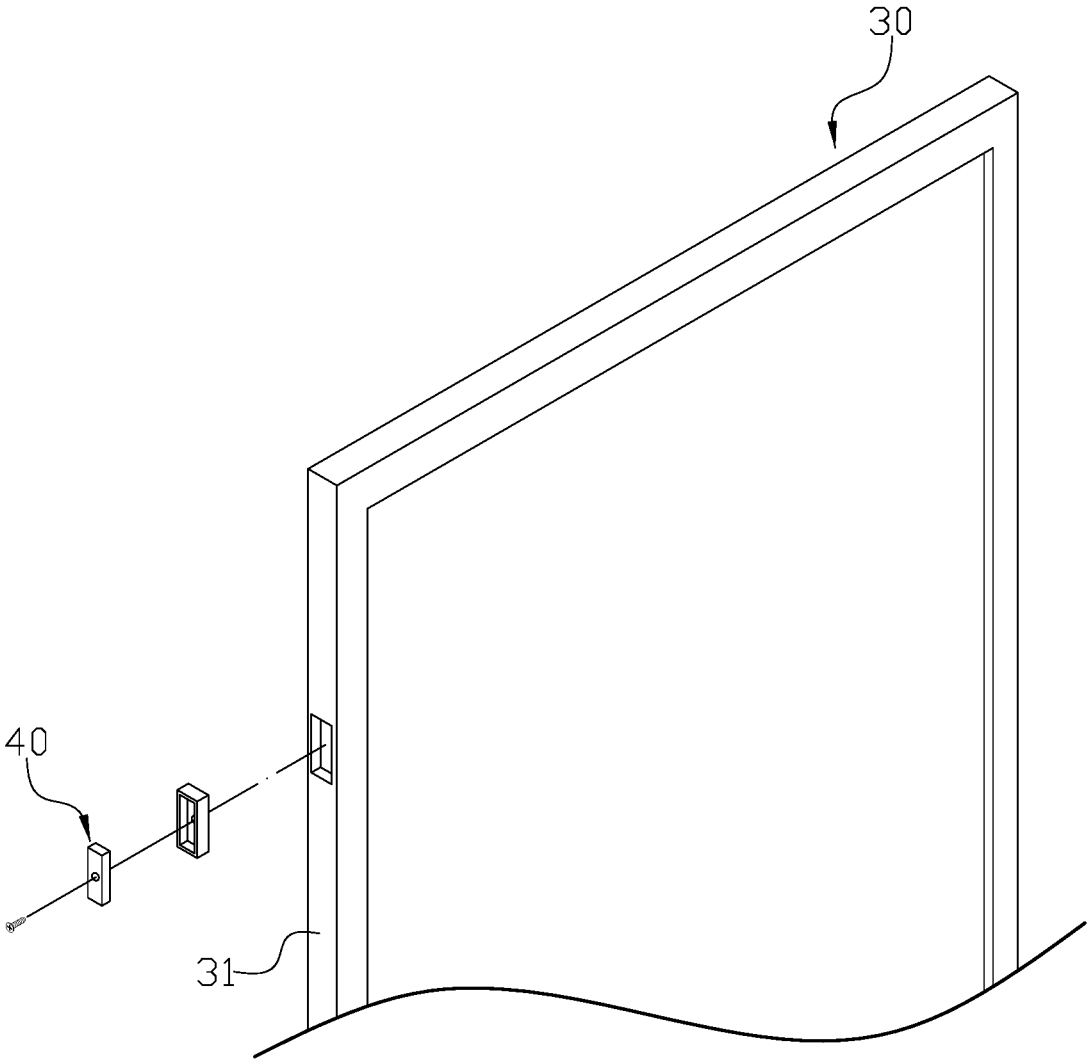
FIG.10 PRIOR ART
FIG. 10 is the structure drawing of a prior art structure.
Figure 11:
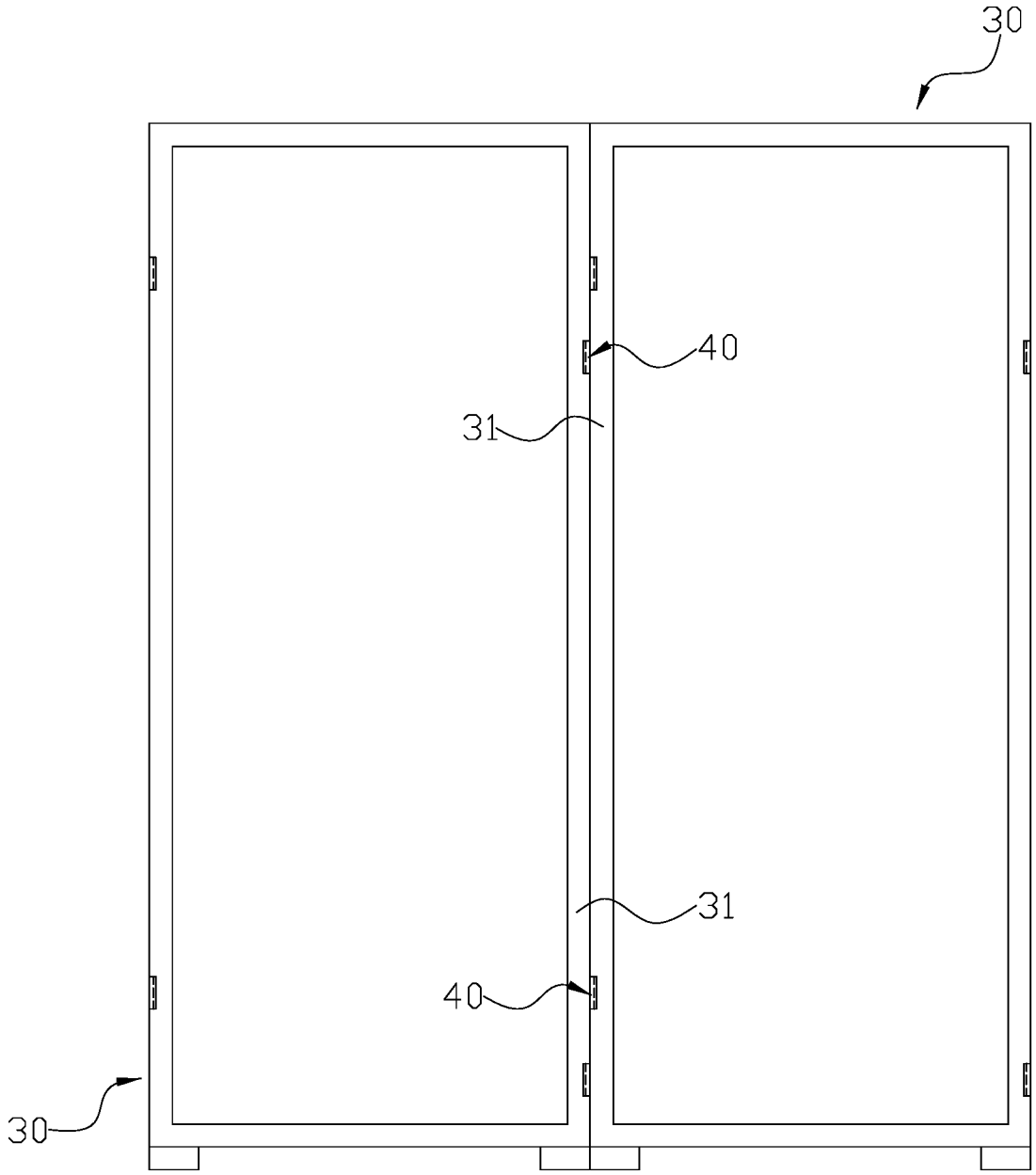
FIG.11 PRIOR ART
FIG. 11 is a magnetic attraction schematic drawing of the prior art structure.

Alternatively, the assembling member 20 has four securing members 21 combining four screens 10 to form a cross shape, as shown in FIG. 9.

Additionally, each side portion of each frame 11 has two magnets 12 on two opposite edges corresponding to assembling member 20.

With the structure of the above specific embodiments, the following benefits can be obtained: the screen 10 uses the assembling member 20 to provide magnetic attraction instead of the frame 11, so that the frame 11 can be made in various materials, not limited to metal. When the frame 11 of the screen 10 is made of non-metallic materials, it can also effectively reduce the overall weight and cost.

Although the present invention has been explained in relation to its preferred embodiment, it is to be understood that many other possible modifications and variations can be made without departing from the spirit and scope of invention as hereinafter claimed.

What is claimed is:

1. A dividing screen structure comprising:

at least two screens and at least one assembling member mounted on one side of one of the two screens for connecting the two screens together;

wherein:

each screen has a frame with at least one magnet on a side for pairing with the assembling member; and the assembling member comprises at least two U-shaped securing members configured to be directly magnetically attracted to each other, each securing member having a back portion, two side portions and an opening, a portion of the frame of each screen disposed in the opening of a respective securing member.

2. The dividing screen structure as claimed in claim 1, wherein the two securing members are connected with the respective back portions, and the openings of the two securing members respectively accept the frame of a respective screen.

3. The dividing screen structure as claimed in claim 1, wherein the back portion of one of the securing members is attached onto one of the side portions of the other securing member, and each opening of the two securing members respectively accepts the frame of a respective screen to combine the two screens at a right angle.

4. The dividing screen structure as claimed in claim 1, wherein the assembling member comprises three securing members, two of the securing members are connected together with the respective back portions, the back portion of another securing member is attached onto each of one of the respective side portions of the two connected securing members, and each opening of the three securing members respectively accepts the frame of a respective screen to combine three screens into a T shape.

5. The dividing screen structure as claimed in claim 1, wherein the assembling member has four securing members combining four screens to form a cross shape.

6. The dividing screen structure as claimed in claim 1, wherein each side portion of each frame has two magnets on two opposite edges.

* * * * *